US006231483B1

(12) United States Patent
Phillips

(10) Patent No.: US 6,231,483 B1
(45) Date of Patent: May 15, 2001

(54) SLIDING EXERCISE APPARATUS AND RECREATIONAL DEVICE

(76) Inventor: Forrest B. Phillips, P.O. 7008, Santa Cruz, CA (US) 95061

( * ) Notice: Subject to any disclaimer, the term of this patent is extended or adjusted under 35 U.S.C. 154(b) by 0 days.

(21) Appl. No.: 09/344,302

(22) Filed: Jun. 24, 1999

(51) Int. Cl.[7] ..... A63B 22/00

(52) U.S. Cl. ..... 482/51; 280/814; 280/842; 482/71

(58) Field of Search ..... 280/842, 814; 482/70, 51, 148

(56) References Cited

U.S. PATENT DOCUMENTS 3,856,321 * 12/1974 Solymossi ..... 280/87.04
4,715,416 * 12/1987 Horne ..... 280/817
5,012,921 * 5/1991 Becker ..... 280/814
5,104,017 * 4/1992 Vandagriff ..... 280/815
5,167,170 * 12/1992 Croteau ..... 280/825
5,564,729 * 10/1996 Gomez et al. ..... 280/637

* cited by examiner

*Primary Examiner*—Jerome W. Donnelly
(74) *Attorney, Agent, or Firm*—Malcolm B. Wittenberg

(57) ABSTRACT

A sliding exercise apparatus used as a recreational device. The device includes a sport board housed within a carrying case. The carrying case has at least a low friction and board protective bottom surface to facilitate sliding the apparatus upon a suitable contact area. The top of the carrying case is provided with removable portions that would enable the user to access the sports board while the board is housed within its carrying case. A user can be supported by the board while in its case and can employ the board and case to navigate upon a suitable support surface.

35 Claims, 9 Drawing Sheets

SLIDING EXERCISE APPARATUS AND RECREATIONAL DEVICE

TECHNICAL FIELD AND INVENTION

The present invention is directed to the combination of a sports board and carrying case which can be used as a recreational sports simulator and exercise device. In practicing the present invention, the avid sports board enthusiast can develop board sport skills even when climactic conditions or geography would otherwise prohibit recreational activities and skill development exercise.

BACKGROUND OF THE INVENTION

Virtually all board sport and ski enthusiasts face the problem of how to maximize recreational practice, skill development and exercise during times of the year when use of such equipment is not feasible. For example, snow boarders find that after a full winter season, their skills are enhanced but after the spring, summer and fall months of inactivity, board skills must be redeveloped and tuned once winter conditions provide the appropriate back drop for practicing the sport.

Not only do winter sport enthusiasts face the grim prospect of having to go long periods between board usage but others such as surfers face similar constraints. Obviously, the surfer can only effectively use a surf board when ocean access is available. There are times when surfers must travel inland and away from major bodies of water preventing board usage.

Most board owners also own protective carrying cases. Cases are employed to not only protect boards during travel but also during storage. Cases are generally provided with one or more carrying straps or handles and protective side walls which are either padded or composed of rigid layers to prevent or at least lessen board damage during storage or travel.

It has now been determined that a sliding exercise apparatus and recreational device can be created by making relatively minor modifications to the design and manufacture of board cases and, in some instances, the boards themselves. Such modifications can convert traditional sports boards, being only periodically useful, to exercise apparatus and recreational devices which can be employed virtually wherever and whenever a user decides to engage in board-related recreational activities. These and further objects would be more readily appreciated when considering the following disclosure and appended claims.

SUMMARY OF THE INVENTION

The present invention deals with a sliding exercise apparatus and recreational device comprising of a sports board housed within a carrying case. The carrying case is characterized as having a top and bottom, the bottom having a low friction and board protective surface to facilitate sliding the apparatus upon a suitable contact area. The carrying case is further characterized as having a top which includes a removable portion to enable a user to access the sports board where the sports board is housed within the carrying case. As such, a user is able to be supported upon the sports board and to navigate the sports board upon the contact area without removing the sports board from the carrying case.

In those instances where the user need not access the surface of the board, the carrying case can be employed without any removable portion. For example, when the present invention is in the form of a body board or a boogie board which does not employ foot bindings, a user can employ the boogie board or a body board in its carrying case without need for a removable portion in its top.

DETAILED DESCRIPTION OF THE INVENTION

Figure 1:
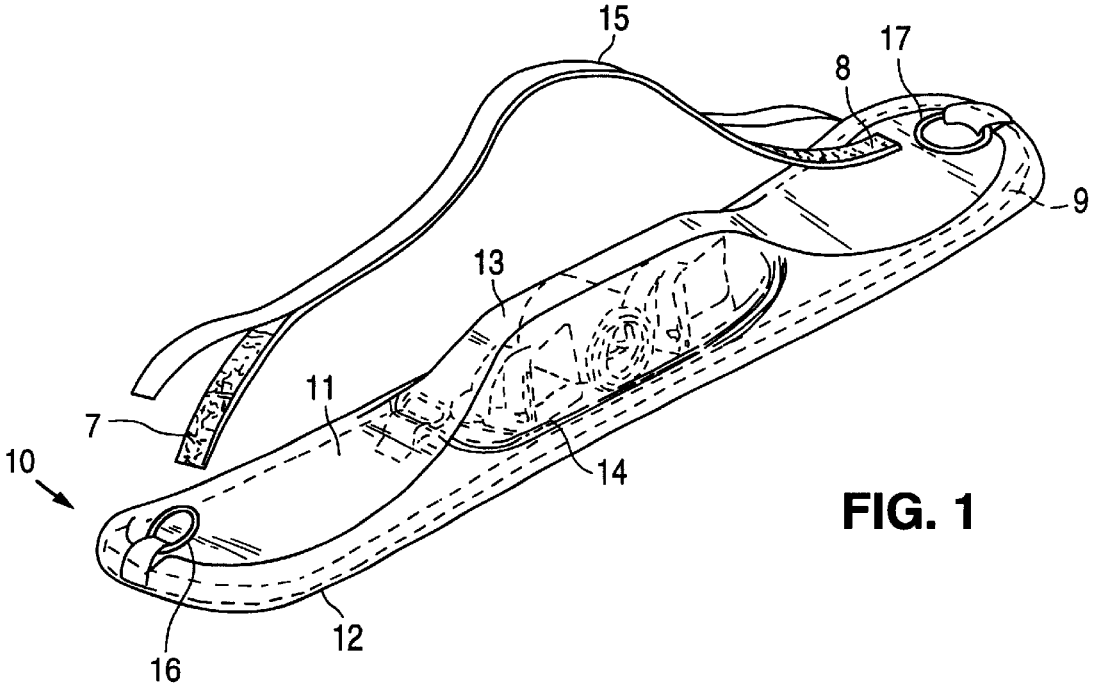
FIGS. 1 and 2 are perspective views of the present invention in the form of a snow board housed within its carrying case.

As noted previously, the present invention deals with a sliding exercise apparatus and recreational device comprising a sports board housed within a carrying case. FIG. 1 illustrates, as element 10, a first iteration of such an apparatus. Specifically, in this instance, snow board 9 shown in phantom includes bindings 18 and 19 (FIG. 2) housed within a carrying case having top surface 11 and bottom surface 12. The carrying case further includes carrying strap 15 secured to the carrying case via Velcro strips 7 and 8 to ring-like carry strap connectors 16 and 17, respectively. In this embodiment, the carrying case is further provided with removable portion 13 held in position through the use of zipper 14. When the carrying case is employed to house and protect the snow board, including its bindings, removable section 13 remains in place (FIG. 1). However, when the sliding exercise apparatus and recreational device of this invention is to be used for those recreational purposes contemplated herein, removable section 13 is withdrawn as shown in FIG. 2.

As noted above, the carrying case is characterized as having top 11 and bottom 12. Top 11 can consist of virtually any protective barrier material traditionally used in carrying cases used to house sports boards. However, for reasons which will become apparent, bottom surface 12 (FIG. 2) is characterized as being a low friction and board protective surface. Bottom 12 can either be padded, or composed of rigid material or even inflatable such that it possesses the low friction and board protective qualities desired in practicing the present invention. Examples of suitable board, protective materials include nylon, Texion, Dacron, polyester resins, injection molded plastics, thermoplastics, vacuum molded plastics, polyvinyl chloride, polyethylene, polystyrene and polytetraethylene.

Figure 2:
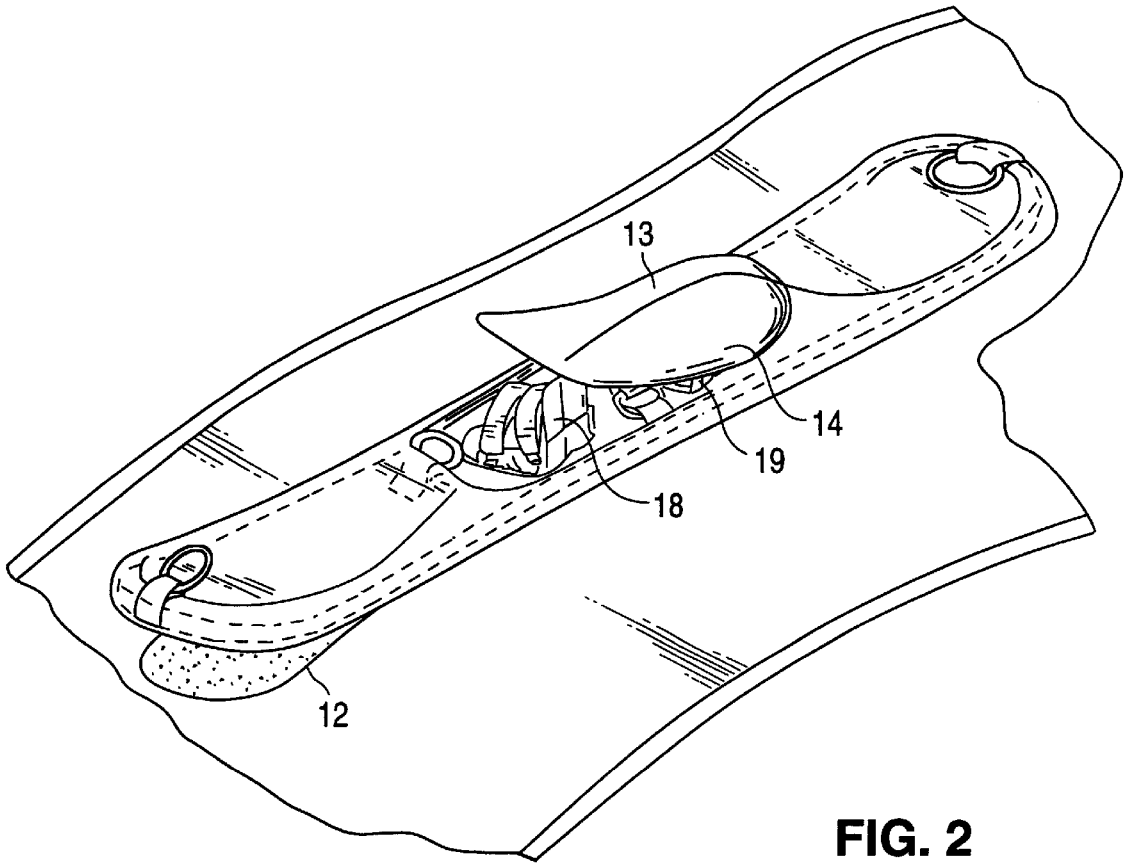
Figure 3:
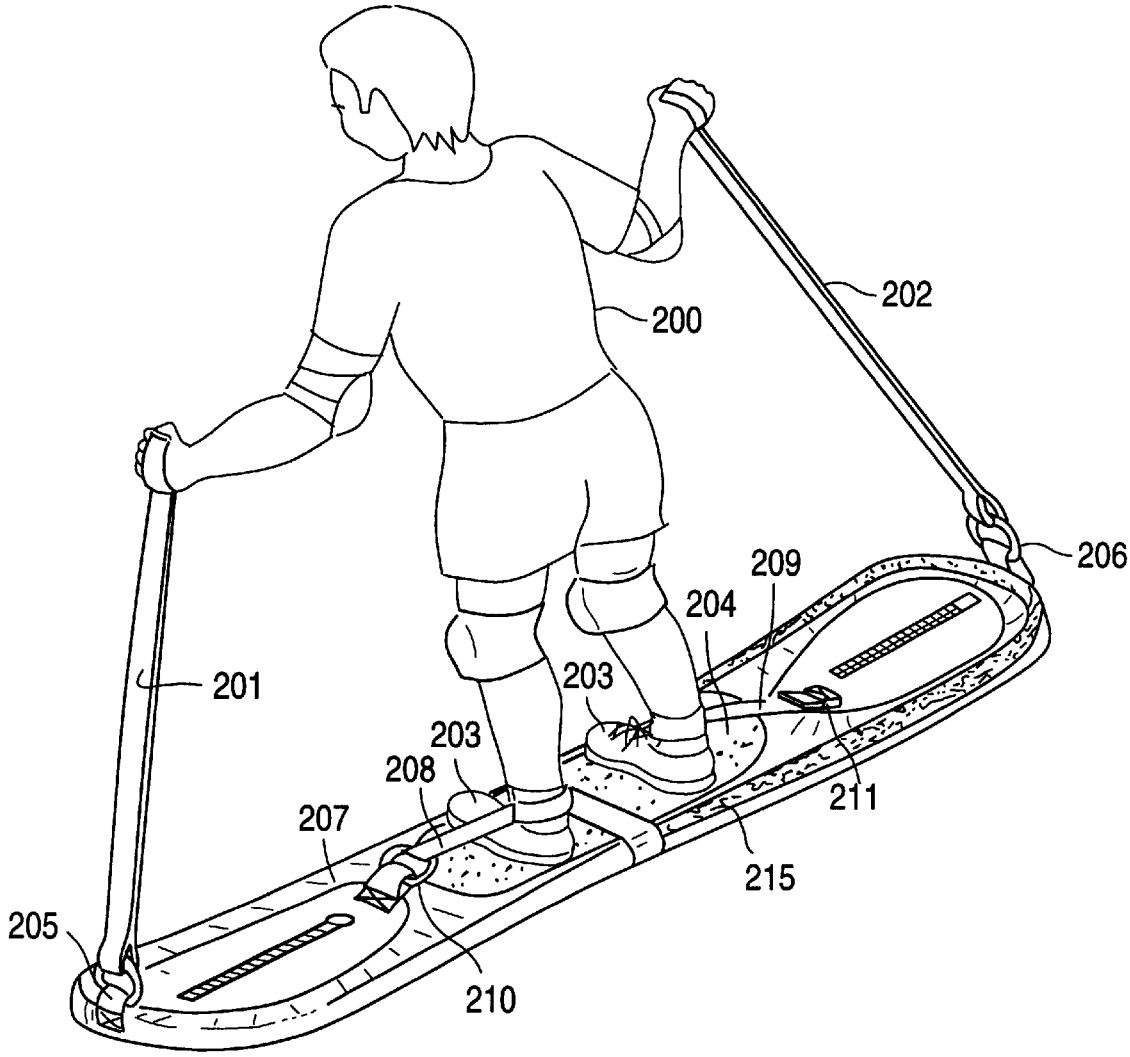
FIG. 3 is a perspective of a user atop the snowboard and carrying case of FIGS. 1 and 2.

Reference is made to FIG. 3 illustrating use of the sliding exercise apparatus and recreational device of FIGS. 1 and 2. Specifically, user 200 is shown employing snow board 204 while the board remains in case 207. Top 13 (FIG. 2) has been removed and the feet of user 200 are secured to board 204 via bindings 203 and 213. Further lateral support can be achieved through the use of ankle straps 208 and 209 secured to carrying case 207 via connectors 210 and 211. To provide a user additional balance, straps 201 and 202 can be connected to carrying strap connectors 205 and 206. As a preferred embodiment, case 207 is provided with edge 215 of rubber or other high friction material to assist a user in controlling the navigation of said sports board upon said contact area.

In summarizing the description of FIGS. 1 to 3, it is noted that the present application is directed to a sliding exercise apparatus and recreational device comprised of a sports board housed within a carrying case, the carrying case being characterized as having a top and bottom, the bottom having a low friction and board protective surface to facilitate sliding the apparatus upon a suitable contact area. As the embodiment of FIGS. 1 to 3 illustrate, a removable top can be provided to enable a user to access the sports board. This enables a user to be supported by the sports board and navigate the sports board upon a contact area without removing the sports board from the carrying case.

Figure 4:
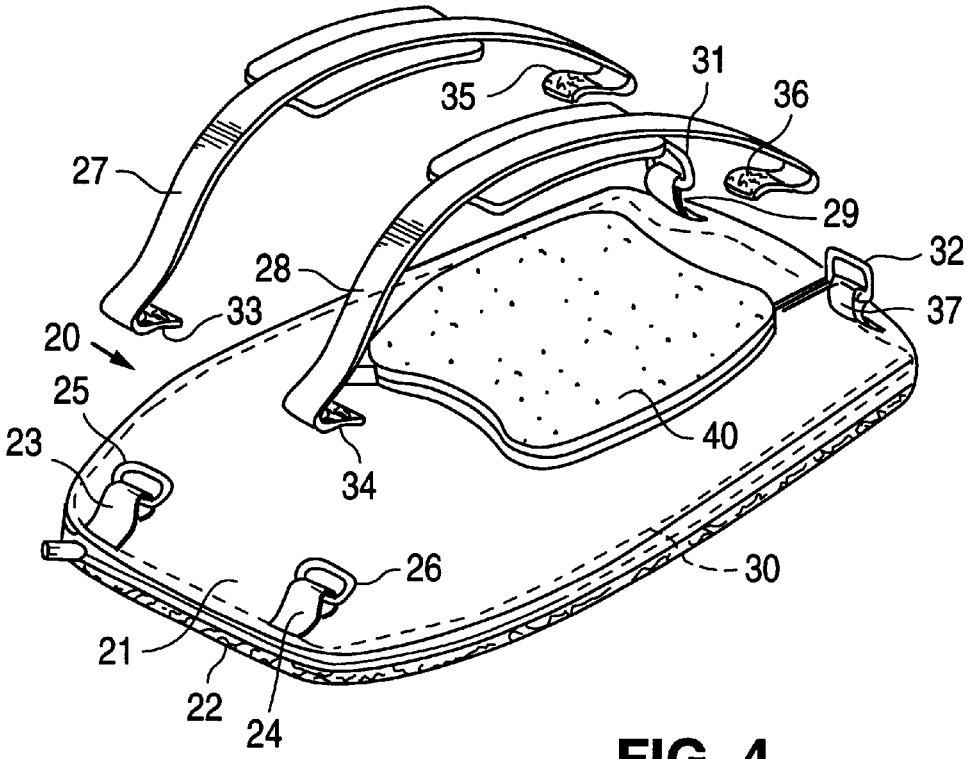
FIG. 4 is a perspective view of the present invention in the form of a boogie board housed within its carrying case.

FIG. 4 illustrates yet another embodiment of the present invention, in this instance, a sliding exercise apparatus and recreational device in the form of a boogie board or body board. This embodiment shown as element 20 includes carrying case 30 and enclosed boogie board or body board 39 shown in phantom. Carrying case 30 is provided with top 21 and bottom 22, the latter, again, comprising a low friction and board protective surface. Carrying straps 27 and 28 are provided and can be suitably connected to carrying case 30 via Velcro strips 33, 34, 35 and 36 connected to rings 25, 26, 31 and 32 which in turn are permanently connected to top surface 21 via fabric strips 23, 24, 29 and 37. Further embraced by top surface 21 is optional accessory storage compartment 40.

Embodiment 20 of FIG. 4 can be employed as any boogie board or body board/carrying case combination of the prior art. In other words, straps 27 and 28 can be grasped by hand or supported by the shoulders of a user while the board is carried to a suitable oceanside location whereupon board 39 is removed from case 30 and employed as a user lies upon the board enabling ocean wave action to carry the user onto shore from an offshore location. However, when it is inconvenient or not practical to use the boogie board or body board as intended, the board can remain within case 30 and the user lying upon it navigates across a suitable, later to be described, contact area. In doing so, straps 27 and 28 can remain in place or they can be removed at one end and employed to provide a user additional stability. Ideally, top surface 21 should be padded or plush to provide the user with a soft, comfortable contact surface. Bottom surface 22, however, as in the previously described embodiments, should consist of a low friction and board protective surface including surfaces which are padded, rigid, shell-like and even inflatable. Suitable surfaces include nylon, sailcloth, Texion, Dacron and synthetic polyester resins. Additionally, this bottom surface of the case can be provided with areas of high friction to enable an advanced user to manipulate the board for performing tricks and creative moves. Unlike the previous embodiment, because a boogie board or body board is not intended to have bindings or other means of attaching a user's feet to the top surface of the board, there is no particular reason to provide the embodiment of FIG. 4 with a removable portion such as that shown as element 13 of FIGS. 1 and 2.

Figure 5:
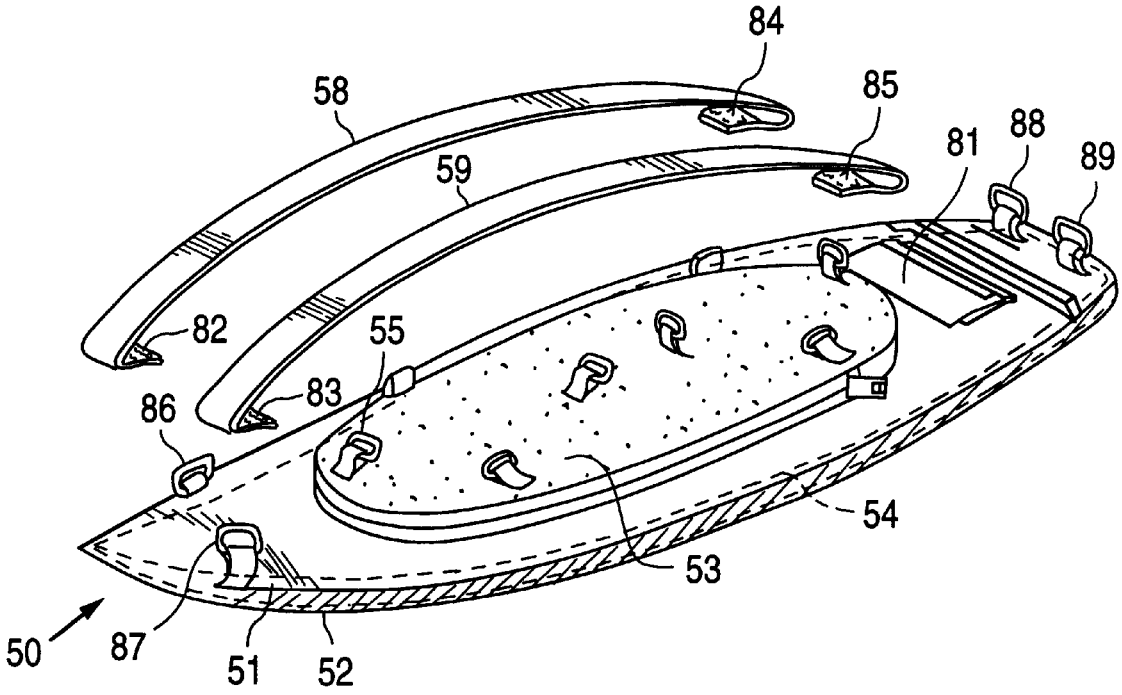
FIG. 5 is a perspective view of the present invention in the form of a surf board housed within its carrying case.

Reference is next made to FIG. 5 illustrating yet a further embodiment of the present invention; in this instance, the combination of surfboard and carrying case 50. Specifically, surfboard 54 shown in phantom is housed within case 56. As in the prior embodiments, case 56 is further provided with preferably plush, soft or high friction top surface 51 and low friction board protective surface 52. Top surface 51 can further be provided with storage area 81 for housing, for example, a removable surfboard fin. Carrying case 56 can further be provided with carrying straps 58 and 59 which can be used in a traditional manner to carry surfboard 54 but can also be used to stabilize a user by removing one or more ends by releasing any of Velcro strips 82, 83, 84 or 85 from buckles 86, 87, 88 or 89 enabling the carrying straps to be employed such as was shown in FIG. 3 in the discussion of straps 201 and 202.

In use, the exercise apparatus and recreational device 50 of FIG. 5 can be employed in the traditional fashion of using carrying case 56 to carry surfboard 54 to a suitable oceanside location. However, when it is either inconvenient or impractical to surf either because of climactic conditions or the inaccessibility of an oceanside venue, surfboard 54 can remain within case 56 and a user employ exercise apparatus and recreational device 50 upon a suitable contact area without removing board 54 from its case. In doing so, a user can simply step upon top surface 51 in area 53 either using straps 58 and 59 for balance or removing the straps entirely if a user feels comfortable in doing so. Alternatively, suitable soft bindings (not shown) can be attached to top surface 51 in area 53 employing buckles 55 for this purpose. Optional add-on bindings will obviously provide a user with additional stability converting the exercise apparatus and recreational device to something akin to the snow board shown in FIGS. 1 and 2. Alternatively, the exercise apparatus and recreational device of FIG. 5 can be employed as a skim board enabling the user to simply lie flat atop surface 51 and navigate device 50 along a suitable contact area. Further, area 53 can be unzipped from top surface 56 and a user can step atop surfboard 54 in a traditional fashion while board 54 remains within case 56.

Figure 6:
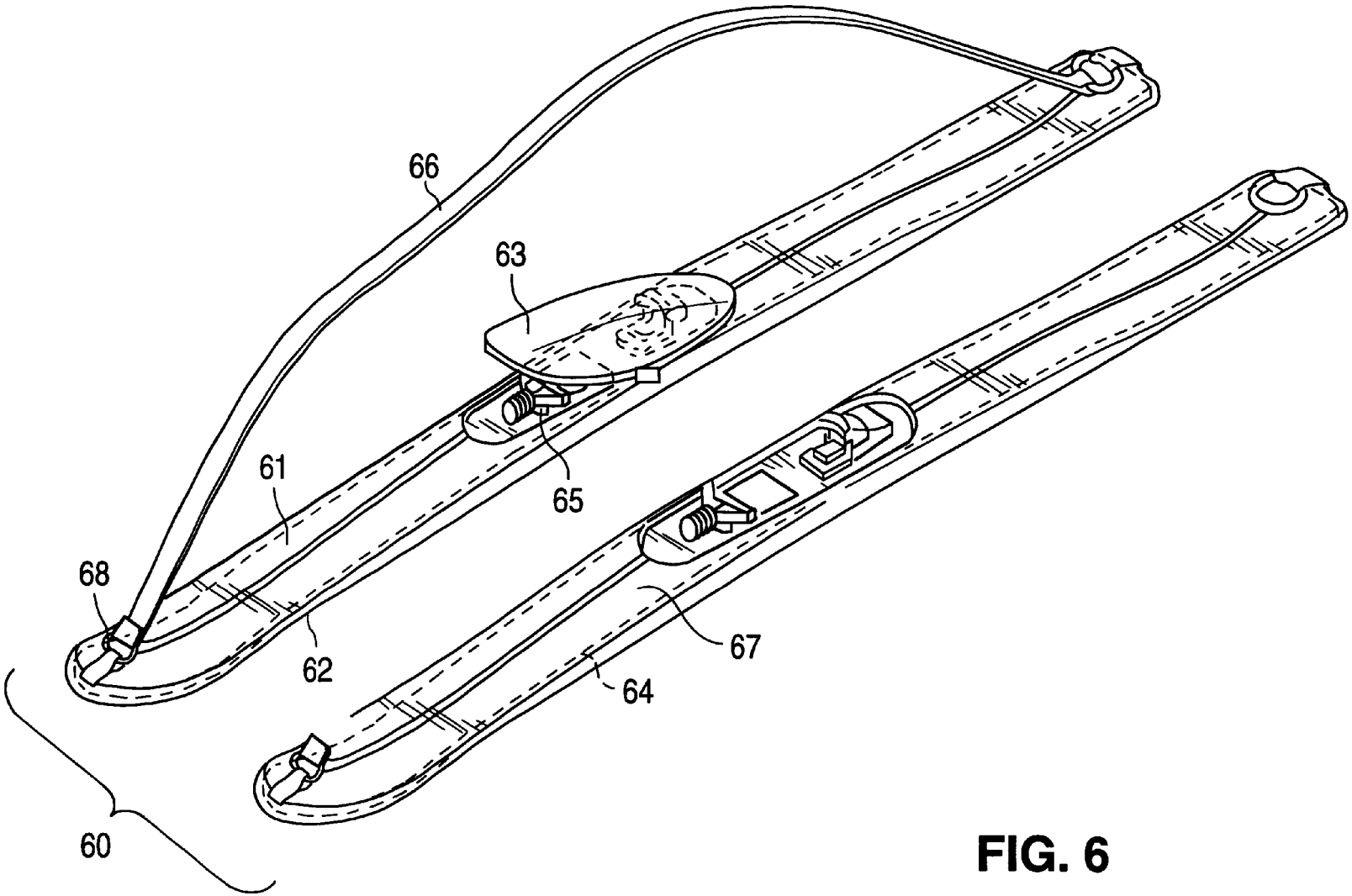
FIG. 6 is a perspective view of the present invention in the form of a pair of skis housed within their carrying cases.

FIG. 6 illustrates yet a further embodiment of the present invention, in this instance, a sliding exercise apparatus and recreational device 60 configured as the combination of ski 64 shown in phantom and case 67. As in previous embodiments, case 67 includes top surface 61 and low friction and ski protective surface 62. Case 67 further is provided with buckle connector 68 removably supporting carrying strap 66 which can be selectively removed from buckle 68 to optionally provide a user additional stability when employed in practicing the present invention.

Ski 64 can employ case 67 as a traditional carrying case whereby skis 64 can be removed from case 67 and employed when alpine conditions present themselves. However, when it is impractical to snow ski, such as during the summer months, ski 64 can remain within case 67 and used as a sliding exercise apparatus and recreational device as taught herein. Specifically, removable portion 63 can be unzipped from top surface 61 exposing binding 65 to a user. One can then simply insert one's feet into suitable ski boots which are then snap-fit within binding 65 while skis 64 remain within case 67.

The embodiment shown in FIGS. 1 through 6 are simply intended to be illustrative. It is specifically noted that virtually any sports board suitable for being housed in a carrying case can be employed, through modification of the case, to practice the present invention.

It was repeatedly noted above that the embodiment shown in FIGS. 1 to 6 are intended to be employable upon a suitable contact area particularly when geographic or climactic conditions prevent use of the above-described sports boards in a manner intended by board manufacturers. The remaining figures depict suitable contact area embodiments for use herein.

Figure 7:
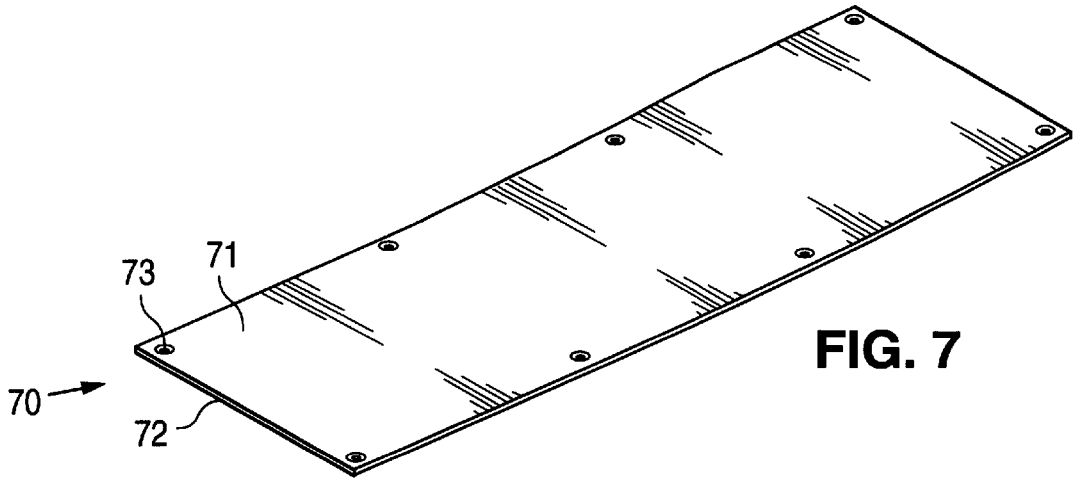
FIGS. 7, 8 and 9 are perspective views of various versions of sheet material useful as contact areas for employing the various sports boards of FIGS. 1–5.

Turning first to FIG. 7, low friction, high durability sheeting material 70 is shown having top surface 71 and bottom surface 72. Sheeting 70, generally in the form of a rectangle, should ideally be composed of low friction high durability surface 71 and a high friction surface 72. For example, top surface 71 can consist of nylon, sailcloth, Dacron, polyester resins or Texion providing a highly durable and low friction contact surface intended to slidably engage the low friction board protective surfaces discussed previously.

Figure 15:
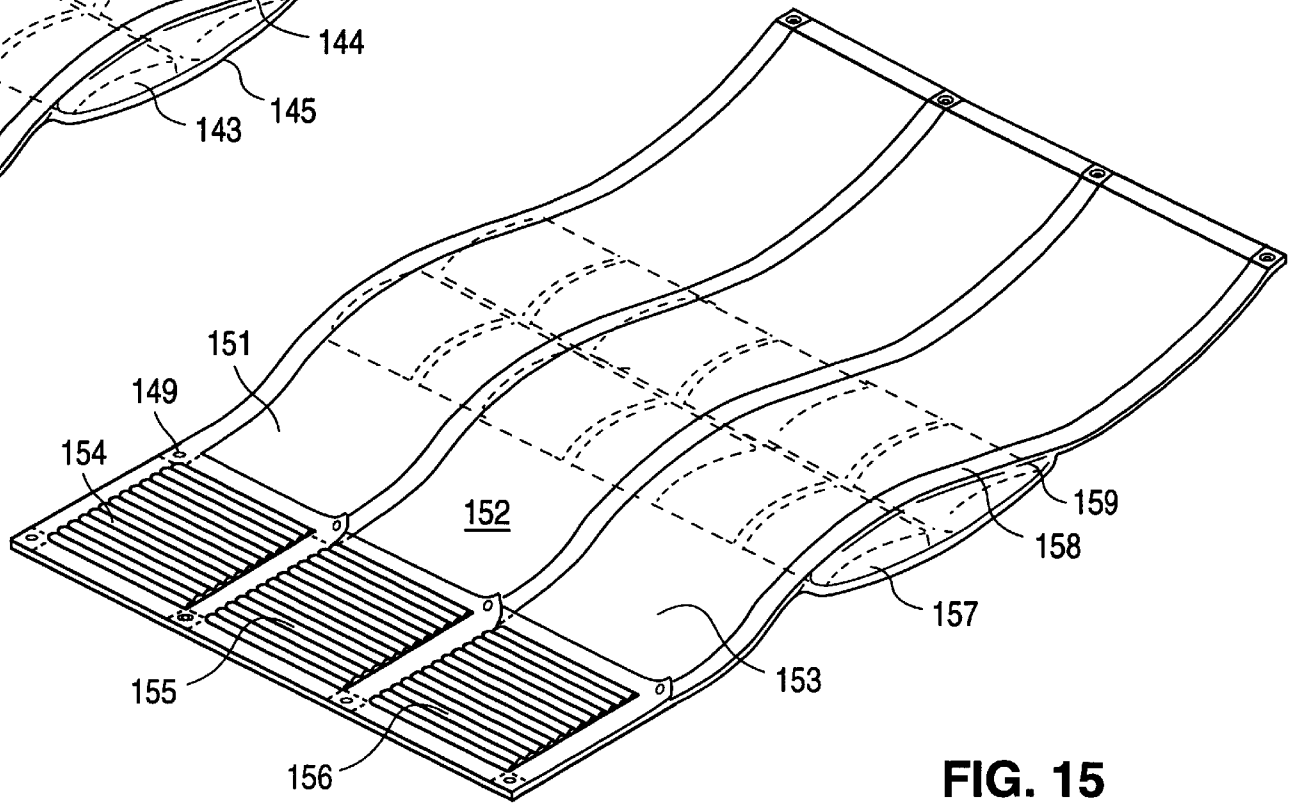
FIG. 15 is yet a further perspective view of various sheeting materials in this instance joined side by side to make a contact area of enhanced width.

FIG. 7 shows a single piece of sheeting material 70 in the form of a rectangle which can be used as a slide enabling the various embodiments shown in FIGS. 1 through 6 to be employed. However, in order to extend the slide area and thus enhance user enjoyment, various pieces of rectangular sheeting material 70 can be connected one to another. As shown in FIG. 7, eyelets 73 are provided which can act as connectors to corresponding eyelets on adjacent sheets 70 for, again, connecting one sheet to another either end to end as shown in FIG. 16 to create a slide of extended length or side to side as shown in FIG. 15 to provide a slide of enhanced width.

Figure 8:
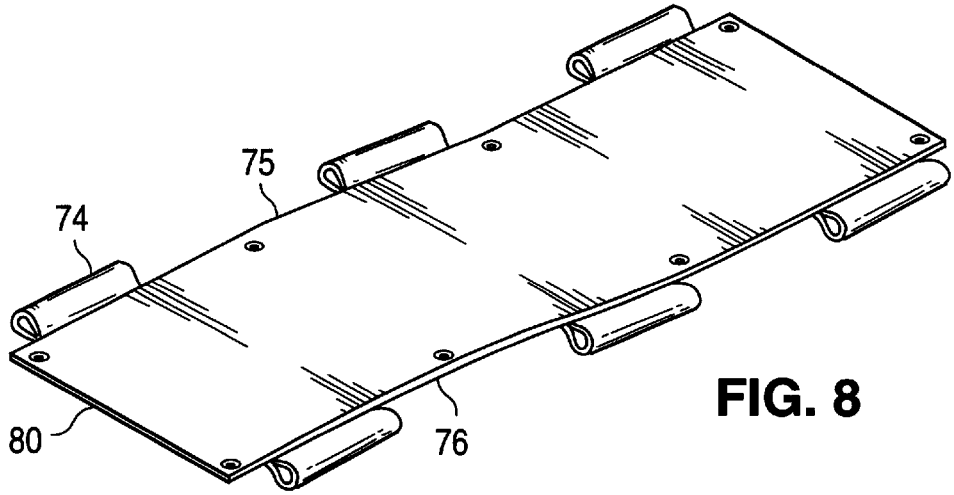
Figure 16:
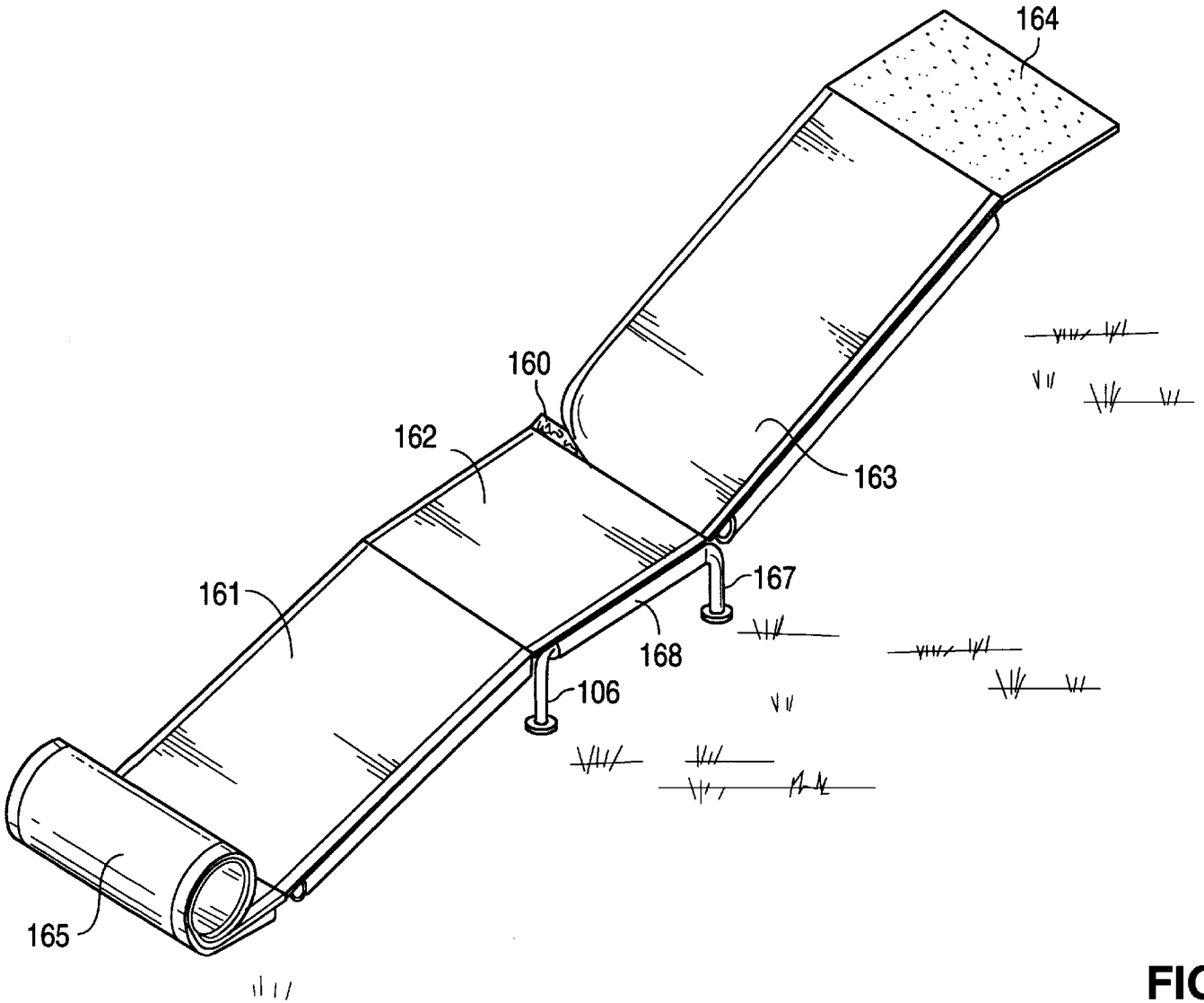
FIG. 16 is a perspective view showing various sheeting materials employed end to end together with certain preferred railing devices in order to produce a contact surface of enhanced length.

As an additional embodiment, and as noted in FIG. 8, sheeting material 80 can alternatively be provided with straps 74 which can be employed on parallel edges 75 and 76 for connecting sheeting material 80 to external supports such as those shown in FIG. 16 as legs 166 and 167 to alter the contour of the slide area.

Figure 9:
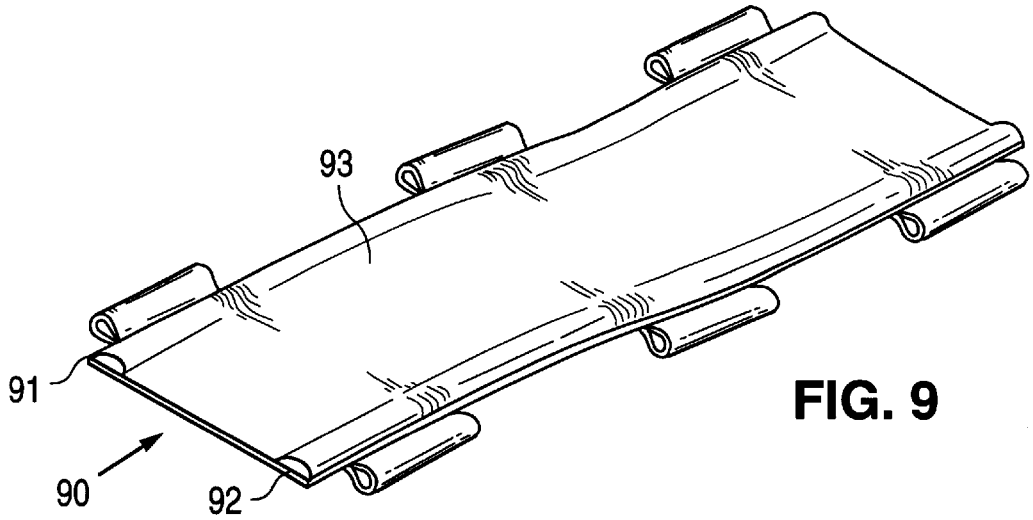
Figure 11:
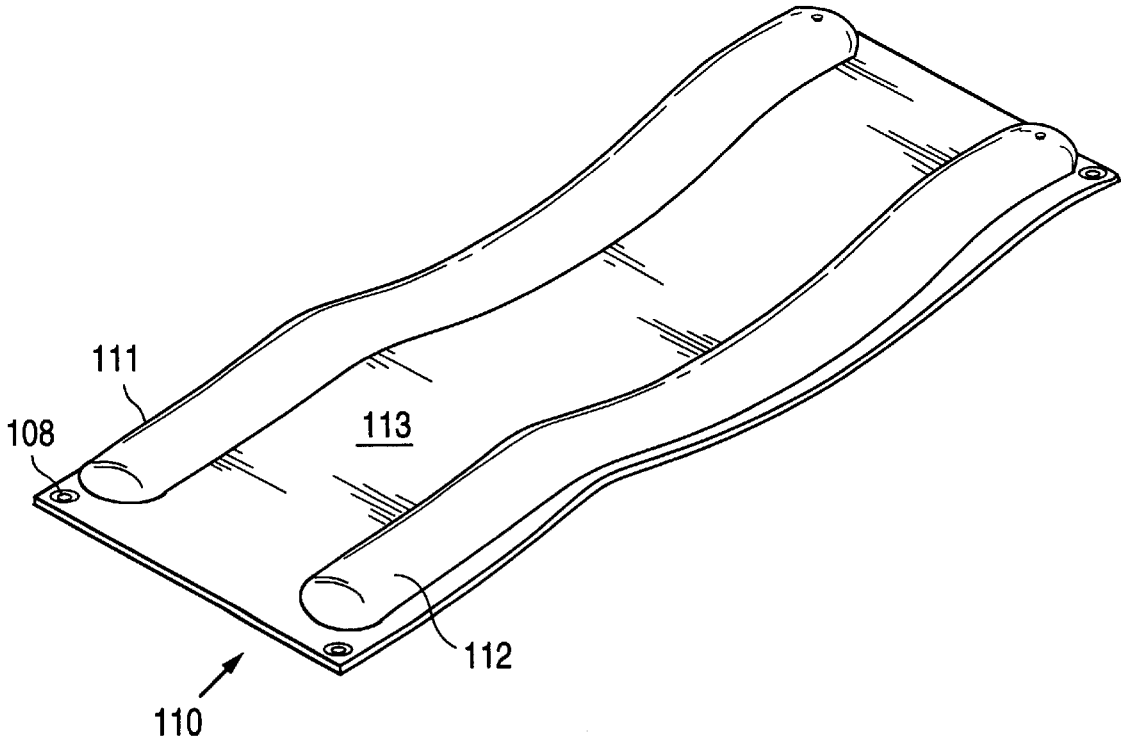
FIG. 11 is a perspective view of yet another version of sheeting material useful as a contact area for employing sports boards of FIGS. 1–5.

Yet a further embodiment is shown in FIG. 9 whereby sheeting material 90 is shown being provided with bumpers 91 and 92. Such bumpers can be applied to the top surface of sheeting 90 either in the form of padded regions or inflatable areas 91 and 92 to assist a user in remaining upon top contact surface 93 and to prevent inadvertent separation from surface 93 during use. A similar embodiment is shown in FIG. 11 whereby inflatable regions 111 and 112 are shown at parallel edges of sheeting material 110, again to assist the user in remaining in contact with surface 13 during use.

Figure 10:
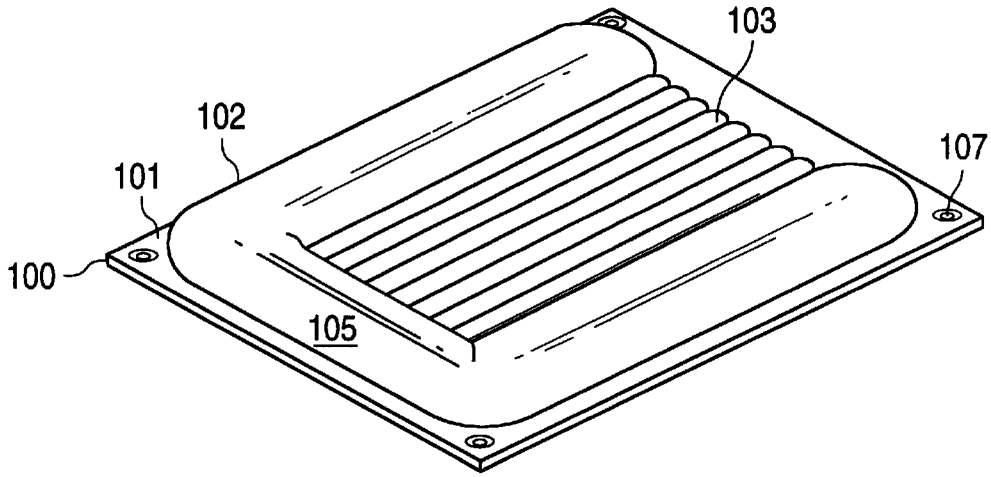
FIG. 10 is a further embodiment of a stopping pad useful in conjunction with the various sheeting material as disclosed in FIGS. 6–8.

It is contemplated that the present invention be provided with starting and stopping areas which further enhance a user's enjoyment and safety. Such an embodiment is shown in FIG. 10 wherein rectangular section 100 is shown as a suitable stopping pad. For example, eyelets 107 can be employed to connect rectangular stopping pad 100 at the end of contact sliding surface 110 (FIG. 11) by attachment to grommets or eyelets 108. Inflated portion 102 not only acts as side bumpers but also the raised U-shaped portion provides the user with an inflated stopping segment 105 helping to prevent the user from traveling beyond the edge of stopping pad 100. In addition, ribs 103 can be provided in the form of high friction surface material, such as rubber, to again facilitate the stopping of a user at the end of the contact surface. As such, when the end unit of FIG. 10 is used in conjunction with the embodiment of FIG. 11, the user will employ the sliding exercise apparatus and recreational device of the present invention along durable low friction surface 113 remaining centered upon such surface through the use of inflated bumpers 111 and 112 until stopping pad 100 is encountered.

Figure 12:
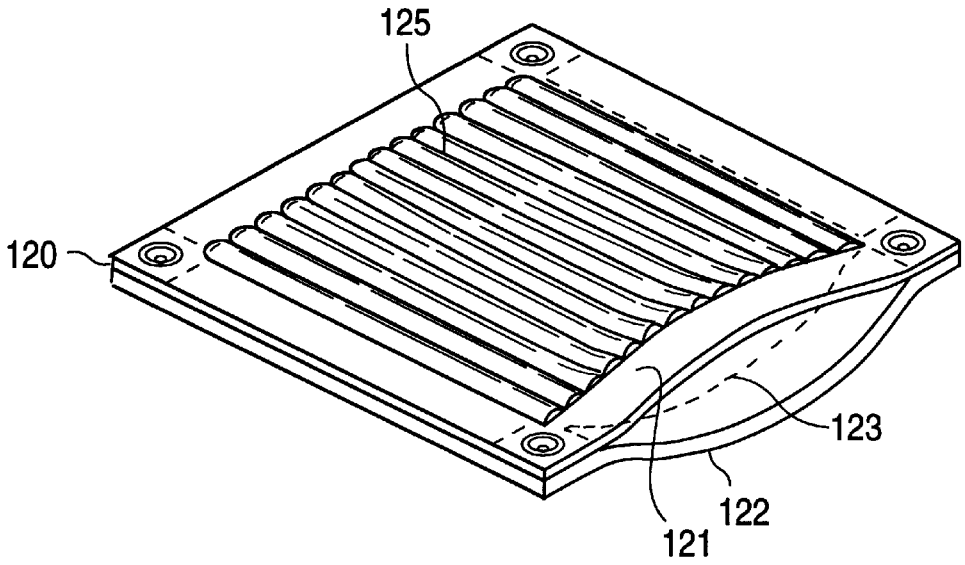
FIG. 12 is yet a further example of a pad used in either the starting or stopping areas upon which the various sports boards of FIGS. 1–5 are intended to navigate further in conjunction with the sheeting materials shown herein.
Figure 13:
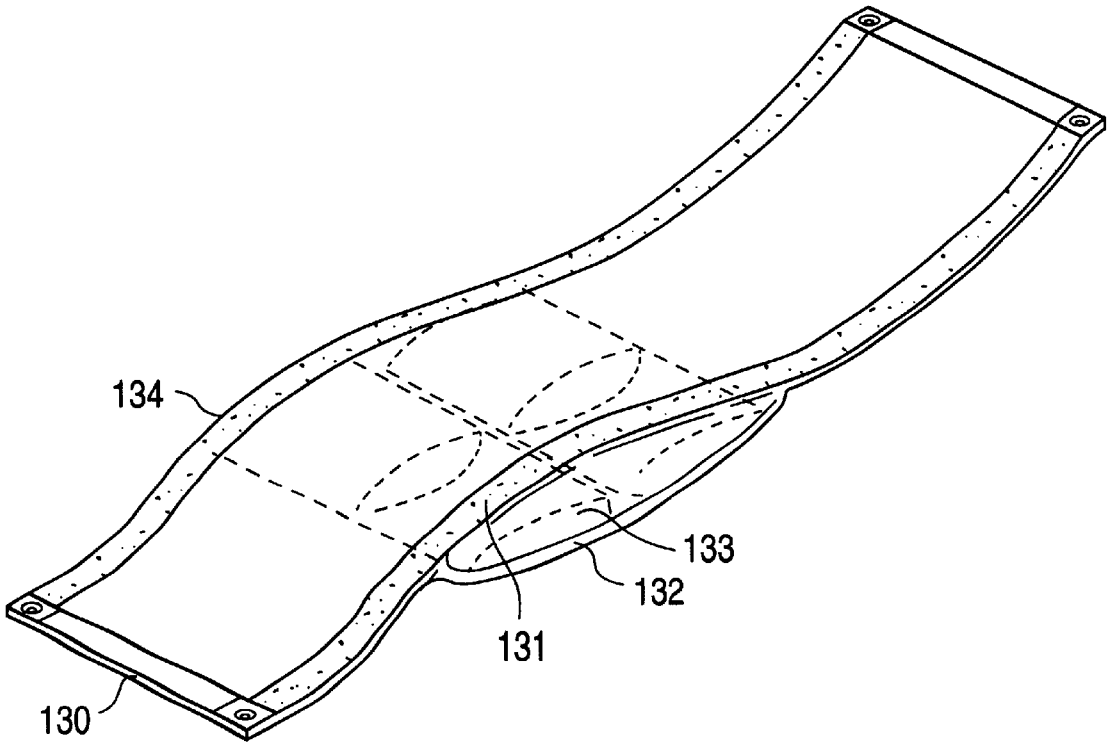
FIGS. 13 and 14 are perspective views of yet a further embodiment of sheeting material useful in conjunction with the use of the sports boards shown in FIGS. 1–6.

As yet a further embodiment, reference is made to FIG. 12 illustrating that sheeting material 120 can be provided with an open pocket area 123 between top surface 121 and bottom surface 122 for receiving padding or stuffing material (element 133 of FIG. 13). Sheeting material 120 can be employed either as a starting or stopping pad by providing high friction or no-skid ridges of rubber or like material 125 on its top surface or can be connected by grommet, Velcro or other connecting means to additional sheeting material such as shown in FIG. 13 to create mogul-like regions to further challenge the advanced user. As further embodiments, FIG. 13 additional shows employing high friction runways 134 which can be used as alternatives to, for example, bumpers 111 and 112 of FIG. 11 to maintain a user upon the low friction top surface of sheeting material 130. As further shown in FIG. 14, the sheeting material of FIG. 12 containing high friction ridges 142 can be employed as an extension to the low friction sliding area 141 including stuffing 143 between top and bottom surfaces 144 and 145.

Figure 14:
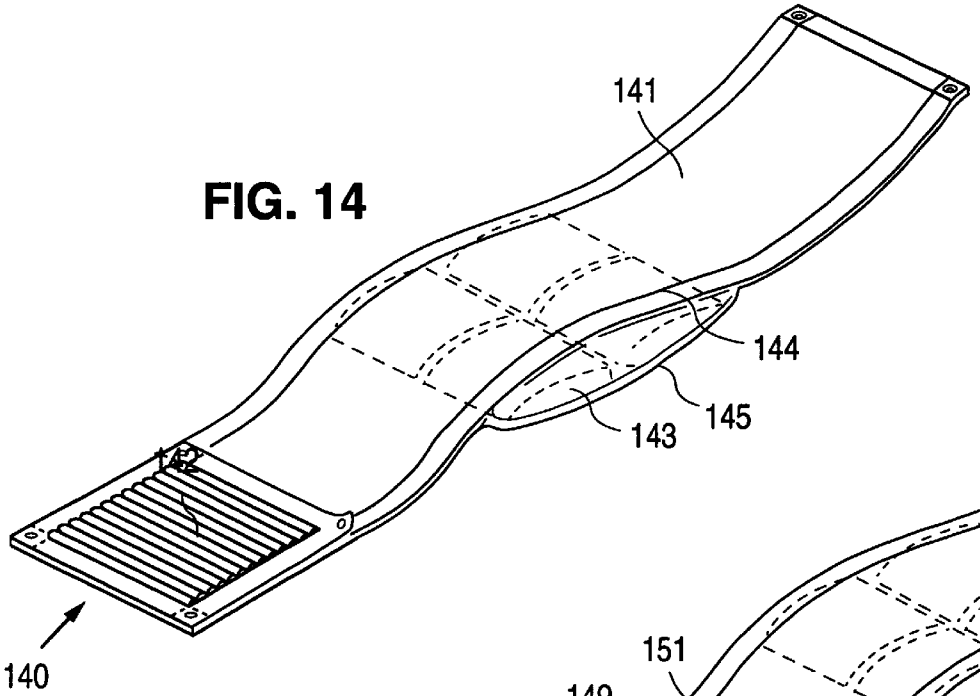

As a further embodiment of the present invention, various sections of sheeting material such as that shown as the composite slide of FIG. 14 can be joined side to side as shown in FIG. 1 5 whereby slides 151, 152 and 153 can be connected through the use of grommets 149. As such, a wide slide surface composed of individual sliding surfaces 151, 152 and 153 can be constructed including moguls created by stuffing 157 between top surface 158 and bottom surface 159. The user in employing the embodiment of FIG. 15 is thus provided with a wide low friction sliding surface which facilitates the use of the present exercise apparatus and recreational device to do twists, turns and jumps as the user gets more facile in practicing the present invention. Further, as in previous embodiments, the embodiment of FIG. 15 can be provided with relatively high friction stopping pads 154, 155 and 156 as shown.

FIG. 16 again shows a suitable low friction sliding surface useful in practicing the present invention. Atop the sliding surface is relatively high friction starting pad 164 and connected thereto various lengths 161, 162 and 163 of suitable sheeting material having highly durable low friction top surfaces. Various lengths of sheeting material can be connected to one another, end to end, employing various connection means. In this instance, segments of sheeting material are shown being connected through the use of Velcro strips 160. In addition, in order to provide the slide surface with preselected contours, one or more segments can be provided with straps 168 which capture suitable tubular frames shown as including legs 166 and 167. The slide of the present invention can be fully extended by unrolling additional segments 165 as needed.

It is quite apparent from the above discussion that the present invention enables the use of sports boards with suitable carrying cases to be employed when geographical or climactic conditions would otherwise prevent their use. No longer does a board enthusiast have to wait until weather conditions or geographical location facilitate engaging in sports board based activities. For example, a snow boarder need not place the snow board in storage once spring arrives. The snow boarder can employ the present invention throughout the year enhancing one's enjoyment of one's sport as well as improving board skills year around.

Upon reading the subject application, various alternative constructions and embodiments will become obvious to those skilled in the art. These variations are to be considered within the scope and spirit of the subject invention. The subject invention is only being limited by the claims which follow and their equivalents.

I claim:

1. A sliding exercise apparatus and recreational kit comprising in combination a sports board housed within a carrying case, said carrying case being characterized as having a top and bottom, said bottom having a low friction and board protective surface to facilitate sliding said apparatus upon a suitable contact area and said top having a removable portion to enable a user to access said sports board while said sports board is housed within said carrying case to enable a user to be supported by said sports board and to navigate said sports board upon said contact area without removing said sports board from said carrying case and at least one piece of low friction, high durability sheeting material as said contact area.

2. The sliding exercise apparatus and recreational device of claim 1 wherein said carrying case bottom is padded to protect said sports board when slid upon said contact area.

3. The sliding exercise apparatus and recreational device of claim 1 wherein said carrying case bottom is inflatable to protect said sports board when slid upon said contact area.

4. The sliding exercise apparatus and recreational device of claim 1 wherein said carrying case bottom is constructed of a rigid material to protect said sports board when slid upon said contact area.

5. The sliding exercise apparatus and recreational device of claim 1 wherein said sports board is provided with bindings for securing the feet of a user, said bindings being accessible to the user while said sports board is housed within its carrying case.

6. The sliding exercise apparatus and recreational device of claim 1 wherein said sports board is provided with clips for releasably connecting bindings to said sports board for securing the feet of a user to said sports board while said sports board is housed within its carrying case.

7. The sliding exercise apparatus and recreational device of claim 1 wherein said carrying case is further provided with a carrying strap.

8. The sliding exercise apparatus and recreational device of claim 7 wherein said carrying strap is sized and positioned on said carrying case to be available to a user to assist the user in maintaining contact with said sports board.

9. The sliding exercise apparatus and recreational device of claim 1 wherein said carrying case is provided with edges of high friction material to assist a user in controlling the navigation of said sports board upon said contact area.

10. The sliding exercise apparatus and recreational device of claim 1 wherein said sports board comprises a body board.

11. The sliding exercise apparatus and recreational device of claim 1 wherein said sports board comprises a boogie board.

12. The sliding exercise apparatus and recreational device of claim 1 wherein said sports board comprises skis.

13. The sliding exercise apparatus and recreational device of claim 1 wherein said sports board comprises a surfboard.

14. The sliding exercise apparatus and recreational device of claim 1 wherein said sports board comprises a snow board.

15. The sliding exercise apparatus and recreational device of claim 1 wherein said contact area comprises at least one piece of low friction, high durability sheeting material having a substantially rectangular geometry.

16. The sliding exercise apparatus and recreational device of claim 15 wherein said contact area comprises at least two pieces of sheeting material attached end to end to create a contact area of extended length.

17. The sliding exercise apparatus and recreational device of claim 15 wherein said contact area comprises at least two pieces of sheeting material attached side to side to create a contact area of extended width.

18. The sliding exercise apparatus and recreational device of claim 15 wherein pieces of sheeting material are attached to one another by the use of Velcro, snaps, zippers or eyelets.

19. The sliding exercise apparatus and recreational device of claim 15 wherein said sheeting material is composed of sailcloth.

20. The sliding exercise apparatus and recreational device of claim 15 wherein said contact area comprises a slide surface of extended length having a starting area, a stopping area and a relatively low friction slide surface area therebetween.

21. The sliding exercise apparatus and recreational device of claim 20 wherein said starting area and said stopping area are composed of a material having higher coefficients of friction than said relatively low friction slide surface area.

22. The sliding exercise apparatus and recreational device of claim 15 wherein means are provided along with a portion of said sheeting material to alter the profile of said contact area.

23. The sliding exercise apparatus and recreational device of claim 22 wherein said means to alter the profile of said contact area comprises a frame of rail segments located beneath a portion of said slide surface.

24. The sliding exercise apparatus and recreational device of claim 22 wherein at least a portion of said sheeting material is inflatable.

25. The sliding exercise apparatus and recreational device of claim 24 wherein substantially parallel borders along two longitudinal edges of said sheeting material are inflatable to provide bumpers along said slide surface.

26. The sliding exercise apparatus and recreational device of claim 24 wherein at least a portion of a terminal end of said sheeting material is inflatable to act as a stopping area of said slide surface.

27. The sliding exercise apparatus and recreational device of claim 22 wherein at least a portion of said sheeting material is provided with a pocket for receiving padding to alter the profile of said contact area.

28. The sliding exercise apparatus and recreational device of claim 15 wherein said at least one piece of sheeting material is provided with a strap on each of two parallel edges thereof for connecting said sheeting material to external supports.

29. The sliding exercise apparatus and recreational device of claim 15 wherein said contact area includes high friction runways.

30. The sliding exercise apparatus and recreational device of claim 1 wherein said bottom having said low friction and board protective surface comprises a member selected from the group consisting of nylon, Texion, Dacron, polyester resins, injection molded plastics, thermoplastics, vacuum molded plastics, polyvinyl chloride, polyethylene, polystyrene and polytetraethylene.

31. A sliding exercise apparatus and recreational device comprising a sports board housed within a carrying case, said carrying case being characterized as having a top and bottom, said bottom having a low friction and board protective surface to facilitate sliding said apparatus upon a suitable contact area and means for facilitating navigation of said sports board upon a suitable contact area configured within the top of said carrying case without removing the sports board from the carrying case.

32. The sliding exercise apparatus and recreational device of claim 31 wherein said support means comprise carrying straps which are sized to be held at one end by a user to assist the user in balancing upon the sliding exercise apparatus and recreational device during use.

33. The sliding exercise apparatus and recreational device of claim 31 wherein said support means comprise buckles for attachment to suitable bindings for receiving the feet of the user in maintaining the user in contact with the top surface of said carrying case during use.

34. A method of employing a sports board for a user to engage in recreational exercise comprising encasing said sports board within a carrying case, said carrying case having a top and bottom, said bottom having a low friction and board protective surface, sliding the board and carrying case upon a contact area while supporting said user whereupon said sports board is navigable by said user upon said contact area as said bottom surface of said carrying case is caused to slide thereon.

35. The method claim 34 wherein said carrying case is further characterized by said top being provided with a removable portion which is removed enabling the user to access said sports board while said sports board is housed within said carrying case such that the user contacts said sports board while said sports board is caused to navigate along said contact area.

* * * * *